United States Patent [19]

Kisler

[11] Patent Number: 4,810,432

[45] Date of Patent: Mar. 7, 1989

[54] METHOD AND APPARATUS FOR ESTABLISHING A UNIFORM CHARGE ON A SUBSTRATE

[75] Inventor: Semyon Kisler, Needham, Mass.

[73] Assignee: Polaroid Corporation, Cambridge, Mass.

[21] Appl. No.: 138,670

[22] Filed: Dec. 28, 1987

[51] Int. Cl.[4] ..... H05F 3/00

[52] U.S. Cl. ..... 264/22; 264/24; 361/213; 361/221; 361/225; 425/174.8 E

[58] Field of Search ..... 264/22, 24, 26; 425/174.8 R, 174.8 E, 174; 427/13; 361/213, 221, 225

[56] References Cited

U.S. PATENT DOCUMENTS

| | | | |
|---|---|---|---|
| 2,641,025 | 6/1953 | Busby, Jr. | 361/225 X |
| 2,802,085 | 8/1957 | Rothacker | 264/26 X |
| 2,908,545 | 10/1959 | Teja | 264/22 X |
| 2,952,559 | 9/1960 | Nadeau | 427/32 |
| 3,634,726 | 1/1972 | Jay | 264/22 X |
| 3,671,806 | 6/1972 | Whitmore et al. | 361/221 X |
| 3,730,753 | 5/1973 | Kerr | 361/213 |
| 3,898,026 | 8/1975 | Sauer et al. | 425/174.8 E |
| 4,363,070 | 12/1982 | Kisler | 361/221 X |
| 4,383,752 | 5/1983 | Kisler | 361/225 X |
| 4,402,035 | 8/1983 | Kisler | 361/213 |
| 4,412,960 | 11/1983 | Goldman et al. | 264/22 |
| 4,517,143 | 5/1985 | Kisler | 264/22 |

FOREIGN PATENT DOCUMENTS

| | | | |
|---|---|---|---|
| 3146826 | 6/1983 | Fed. Rep. of Germany | 425/174.6 |
| 51-41762 | 4/1976 | Japan | 264/22 |
| 51-41763 | 4/1976 | Japan | 264/22 |
| 55-148128 | 11/1980 | Japan | 264/22 |
| 57-207024 | 12/1982 | Japan | 264/26 |
| 883218 | 11/1961 | United Kingdom | 264/22 |
| 1100414 | 1/1968 | United Kingdom | 264/22 |

*Primary Examiner*—Jeffery Thurlow
*Assistant Examiner*—Leo B. Tentoni
*Attorney, Agent, or Firm*—John J. Kelleher

[57] ABSTRACT

A method and apparatus for establishing a uniform electrostatic charge of selected magnitude and polarity on a randomly charged web. The method and apparatus include first and second uniform electrostatic fields of predetermined magnitudes and of opposite polarities spaced from one another. Apparatus is provided for mechanically vibrating each electrostatic field at a particular magnitude and frequency while alternately passing the randomly charged web through each such electrostatic field at a particular angle with respect to the direction of field vibration to thereby establish a uniform magnitude and polarity electrostatic charge on the randomly charged web.

11 Claims, 2 Drawing Sheets

METHOD AND APPARATUS FOR ESTABLISHING A UNIFORM CHARGE ON A SUBSTRATE

BACKGOUND OF THE INVENTION

The present invention relates to the electrostatic charging of a web of randomly charged, relatively high resistivity material, in general, and to the uniform charging of such material, in particular.

Random magnitude and/or polarity electrostatic charges on a web of material can produce any number of quality defects in a coating subsequently applied to such material. These defect generating random charges may be of the bounded type that are sometimes referred to as polarization or polar charges, of the free or unbounded type commonly referred to as surface charges or as is most often the case, a combination of both types of electrostatic charges. Present day use of relatively high resistivity web materials (normally materials having a surface resistivity of $10^{13}$ ohms per square or greater) such as polyester based materials and the like, increases the likelihood of the presence of these unwanted random electrostatic charges on such materials.

In the magnetic media coating industry, for example, where such magnetic media products as video tapes, floppy discs and the like are manufactured, the presences of random electrostatic charges on a high resistivity web can result in significant imperfections or voids in a subsequently applied magnetic media coating. These imperfections occur because the random electrostatic charges attract dust particles to the web surface whose presence thereon prevents proper adhesion or bonding between that portion of the web surface beneath the electrostatically attracted dust particle and a subsequently applied coating. Also, in the photographic industry non-uniform thickness distributions of certain photographic coating materials often results when these materials are applied to a randomly charged, relatively high resistivity web. The use of a layer of such materials in, for example, a photographic film unit to form the positive and/or negative component thereof has often required the use of relatively thick coatings in order to provide some minimum thickness coating layer throughout a film unit component and thereby compensate for this non-uniformity.

Several different techniques are presently employed in establishing a uniform magnitude electrostatic charge level of either positive, negative or neutral polarity on a web of material in both the magnetic media and photographic coating industries. In U.S. Pat. No. 4,517,143 to KISLER, web charging apparatus for establishing a uniform magnitude electrostatic charge of either positive, negative or neutral polarity is disclosed. A uniform electrostatic charge level is established on a randomly charged web by alternately passing the web through two electrostatic fields of predetermined magnitudes and of opposite polarities that are spaced from one another. In U.S. Pat. No. 2,952,559 to NADEAU, a randomly charged web is passed between a pair of opposed grounded pressure rollers that are spring-force biased against opposite surfaces for neutralizing bounded-type electrostatic web charges. Ionized air is subsequently blown onto the web surface to control free charges thereon. Also, in U.S. Pat. No. 3,730,753 to KERR, web surface charges are controlled by initially "flooding" a randomly charged web surface and thereafter removing the charge imparted to the web surface so as to leave the surface generally free of electrostatic charge.

The charge controlling technique described in the above-noted KISLER patent is quite effective in controlling electrostatic charges of both the bounded and surface types so that a photographic coating layer, of uniform thickness, can be applied to a randomly charged web. However, when this apparatus is employed to neutralize dust-particle-attracting random web charges for web cleaning purposes in order to avoid introducing the magnetic media imperfections noted above, the electrostatic charge established by said KISLER apparatus is not of sufficient uniformity to neutralize many of the electrostatic charges that are capable of attracting extremly small, imperfection-generating dust particles to a web surface. In addition, while the web controlling techniques described in the above-cited patents to NADEAU and KERR are effective in neutralizing free or surface-type electrostatic charges, they have either limited or no effect on electrostatic charges of the polarization or bounded-type.

The primary object of the present invention is, therefore, to provide a method and apparatus for uniformly charging a web of randomly charged material.

Another object of the present invention is to provide a method and apparatus for neutralizing bounded and unbounded electrostatic charges on a randomly charged web.

A further object of the present invention is to provide a method and apparatus for establishing a uniform positive, negative or neutral electrostatic charge level on a randomly charged web.

Other objects, features and/or advantages of the present invention will be readily apparent from the following description of the preferred embodiment thereof taken in conjunction with the accompanying drawings.

SUMMARY OF THE INVENTION

In accordance with the teachings of the present invention, a method and apparatus are provided for uniformly charging an electrostatically charged web having random magnitude and polarity charges thereon of the bounded and/or unbounded type. The method and apparatus include first and second relatively uniform electrostatic fields of predetermined magnitudes and of opposite polarities spaced from one another. Means are provided for vibrating each of said electrostatic fields, in a predetermined direction, at a selected amplitude and frequency. Means are also provided for alternately passing said web through each said electrostatic field at a particular angle with respect to its respective direction of electrostatic field vibration to thereby establish a uniform magnitude electrostatic charge thereon of either positive, negative or neutral polarity.

DESCRIPTION OF THE PREFERRED EMBODIMENTS

Figure 1:
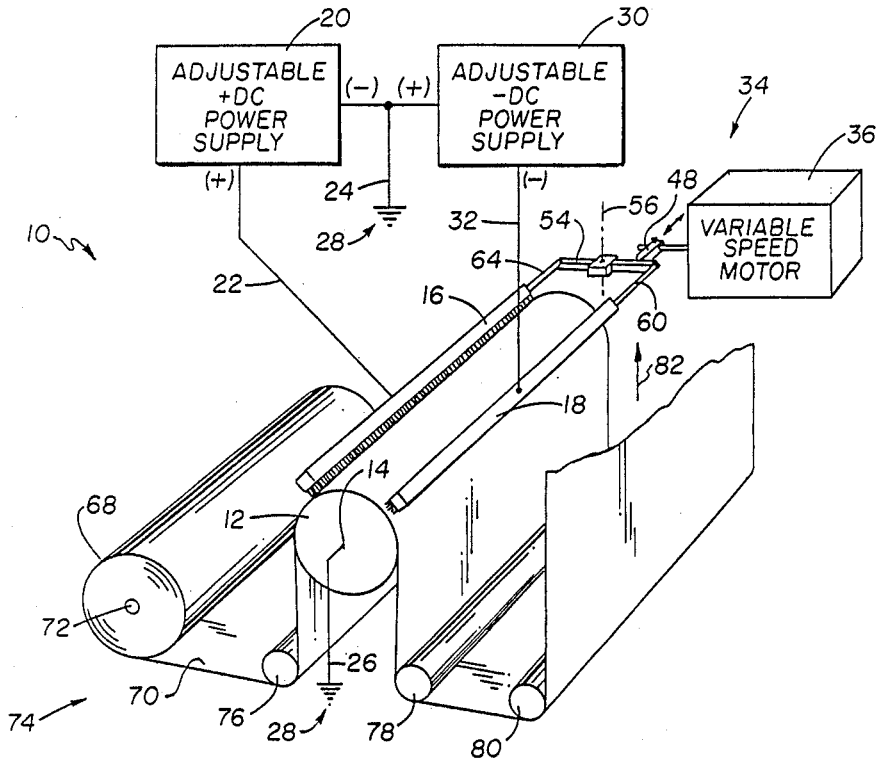
FIG. 1 is a schematic diagram of a preferred embodiment of the web charge controlling apparatus of the present invention.

In FIG. 1 of the drawings, web charge controlling apparatus 10 incorporating a preferred embodiment of the present invention, is depicted. Apparatus 10 includes cylindrically shaped, electrically conductive support or backing roll 12 mounted for rotation about axis 14. A pair of elongated conductive bristle brushes 16 and 18 are mounted for reciprocating xovement in the direction of said axis 14 in a spaced relation with respect to each other, adjacent the cylindrical outer surface of said backing roll 12. The longitudinal or axes of elongation of brushes 16 and 18 are generally parallel to said backing roll axis 14 and the tips or free ends of the bristles forming each of these brushes are spaced from said cylindrical backing roll surface.

The bristles of brushes 16 and 18 are made of stainless steel, are approximately 5 microns in diameter and all of the bristles forming brush 16 or brush 18 are electrically connected to one another. An example of conductive bristle brush of the type employed in the charge controlling apparatus of the present invention is shown in U.S. Pat. No. 4,402,035 to KISLER.

Each of the bristles of conductive bristle brush 16 is connected to the positive output terminal of adjustable DC power supply 20 through path 22. In addition, electrically conductive backing roll 12 is connected to the negative output terminal of said power supply 20 through paths 24, 26 and system ground 28. Similarly, each of the bristles of conductive bristle brush 18 is connected to the negative output terminal of adjustable DC power supply 30 through path 32 and said electrically conductive backing roll 12 is also connected to the positive output terminal of power supply 30 through said paths 24, 26 and system ground 28.

Charge controlling apparatus 10 also includes vibration apparatus 34 for mechanically vibrating conductive bristle brushes 16 and 18 in a preferred direction at a selected magnitude and frequency. Vibration apparatus 34 includes energizable variable speed motor 36 that provides the force required to vibrate brushes 16 and 18. In addition, and as best shown in drawing FIG. 2, cam 38 of vibration apparatus 34 is mounted in a fixed position on the shaft 40 extending from the rotating member (not shown) of variable speed motor 36 (FIG. 1). Cam follower 42 is mounted for pivotal movement about axis 44. One end of cam follower 42 engages surface 46 of cam 38 and push rod 48 is adapted to slidably engage the other end of said cam follower 42. Set screw 50 is manually adjustable to prevent relative movement between cam follower 42 and rod 48 after said rod 48 has been moved to a selected location on cam follower 42. A spring (not shown) provides a biasing force in direction 52 whose function is to rotate push rod follower 42 about axis 44 and into constant engagement with surface 46 of cam 38.

Push rod follower 54 is mounted for pivotal movement about axis 56. One end of push rod follower 54 is pivotally attached by pin 58 to the free end of shaft 60 extending from conductive bristle brush 18. The other end of said push rod follower 54 is pivotally attached by pin 62 to the free end of shaft 64 extending from conductive bristle brush 16. Another spring (not shown) provides a biasing force in direction 66 whose function is to rotate push rod follower about axis 56 and into constant engagement with the free end of push rod 48.

When cam 38 is rotated by variable speed motor 36 at a predetermined rate of speed, cam follower 42 oscillates about axis 44. Push rod 48 transfers this oscillatory motion to push rod follower 54 thereby causing said follower 54 to oscillate about axis 56. As push rod follower 54 oscillates about axis 56, conductive bristle brushes 16 and 18 that are pivotally attached to the distal ends thereof simultaneously vibrate said brushes in opposite directions and generally parallel to rotational axis 14 of backing roll 12 (FIG. 1).

As shown in FIG. 1, roll 68 of relatively high-dielectric polyester based material 70 is rotatably supported on mandrel 72, at unwind station 74. The term "dielectric" as used herein means a material having a surface resistivity equal to or greater than $1\times10^{13}$ ohms per square. A web of material 70 is unwound from roll 68, is routed over idler roller 76, through the space between the ends of the bristles of conductive bristle brush 16 and backing roll 12 and then through the space between the ends of conductive bristle brush 18 and said backing roll 12, respectively. One surface of web 70 is in intimate contact with a portion of the outer cylindrical surface of backing roll 12 with the opposed or opposite web surface being spaced a finite distance from the free ends of the bristles of said conductive bristle brushes 16 and 18. Web 70 is then routed over idler rollers 78 and 80 in direction 82 to either a web coating applicator (not shown) or to a conventional rewind station for subsequent storage.

When a voltage of predetermined magnitude is connected between the bristles of conductive bristle brushes 16 and 18 and conductive backing roll 12, relatively intense electrostatic fields are established between the tips or free ends of the bristles of said brushes and said backing roll 12. The above-noted small bristle diameter makes possible the generation of these relatively intense electrostatic fields with voltage levels that are well below those necessary for the generation of corona, voltage levels that are normally within the range of from 1,000 to 2,000 volts. The intensity and polarity of these electrostatic fields are primarily determined by the magnitude and polarity of the voltage between bristle tips and the outer surface of conductive backing roll 12, bristle diameter and the distance between the bristle tips and said outer cylindrical surface of backing roll 12. In addition, the above-noted small bristle diameter necessarily makes possible high bristle density and therefore increased concentration of the electrostatic fields generated by said conductive bristle brushes 16 and 18. This greater concentration of electrostatic fields will produce better charge uniformity on, for example, a web of dielectric material than a field produced by a conductive bristle brush having larger diameter bristles.

An attempt is made to terminate the tips of free ends of every bristle forming a conductive bristle brush in the form of a plane in order to maintain the same bristle tip to backing roll distance to thereby avoid the variations in electrostatic field intensity and in the uniformity of the electrostatic charge produced by such a field that variations in these distances would produce. However, due to manufacturing limitations it is not possible to construct a conductive bristle brush where the ends of every bristle forming such a brush terminate in a single plane. The uniformity of an electrostatic charge established on, for example, a dielectric web by an electrostatic field generated by a conductive bristle brush is limited both by minimum bristle diameter and by the extent to which the bristles of said conductive bristle brush are of uniform length. In prior web charging apparatus employing conductive bristle brushes to generate electrostatic fields, these bristle length and diameter limitations were compensated for, in part, by increasing the number of bristles in the direction of web movement through the conductive bristle brush generating electrostatic field. The greater the number of bristles, the more uniform the electrostatic charge established on a dielectric web by an electrostatic field generated by such a conductive bristle brush. However, the number of bristles that can be added to a conductive bristle brush in, for example, the direction of web movement is limited by the radius of curvature of the web supporting backing roll adjacent thereto. As the thickness of the brush increases, so will the distance between the tips of the added bristles and the adjacent cylindrical backing roll surface. Even if the conductive surface adjacent the bristle tips were planar or bristle length followed the contour of the cylindrical backing roll surface, minimum bristle diameter would still place a limitation on web charge uniformity. The apparatus of the present invention substantially reduces these limitations by vibrating the conductive bristle brush that generates the charge controlling electrostatic field, at a selected magnitude and frequency and preferably at right angles to the direction of web movement through said electrostatic field.

In order to establish a uniform positive charge level on a randomly charged web with charge controlling apparatus 10, it is essential that a negative voltage be applied to conductive bristle brush 16, a positive voltage be applied to conductive bristle brush 18 and the randomly charged web be moved through the electrostatic field generated at brush 16 and then through electrostatic field generated at brush 18. Conversely, in order to establish a uniform negative charge level on a randomly charged web with charge controlling apparatus 10, a positive voltage must be applied to conductive bristle brush 16, a negative voltage must be applied to conductive bristle brush 18 and the randomly charged web must be moved through the electrostatic field generated at brush 16 and then through the electrostatic field generated at brush 18. To neutralize the electrostatic charges on a randomly charged web, the web must be subjected to both types of electrostatic fields. However, the order in which each said electrostatic field is applied to a randomly charged web is immaterial.

It should be noted that the term "uniform charge" as used herein means a bounded and/or unbounded electrostatic charge of constant magnitude and of either positive, negative or neutral polarity that is uniformly distributed throughout a particular material or combination of materials. It should also be noted that the term "random charge" as used herein means bounded and/or unbounded electrostatic charges of the same magnitude and of different polarity or of different magnitude and of the same polarity, or various combinations thereof distributed throughout the material described as being randomly charged. Also, and as noted above, the charging apparatus of the present invention may be employed to produce a positive, negative or neutral electrostatic charge on a web of randomly charged material. The apparatus is particularly effective on dielectric materials (as defined above) and is effective in controlling both bounded or polar charges and unbounded or free charges.

OPERATION

In the explanation of the operation of the above-described charge-controlling apparatus that follows, it will be assumed that randomly charged web 70 is a four mil thick relatively high dielectric polyester based material that has both positive and negative bounded and unbounded electrostatic charges thereon and that a uniform 200 V negative charge level is to be established on said polyester web 70.

Prior to establishing the desired uniform electrostatic charge level on randomly charged polyester web 70, the output voltages of adjustable DC power supplies 20 and 30 must be adjusted to DC voltage levels that will produce the desired minus 200 V web charge level. For three mil polyester based web 70, it has been empirically determined that plus DC power supply 20 is preferably adjusted to plus 1,000 VDC and that minus DC power supply 30 is preferably adjusted to minus 700 VDC. In addition, conductive bristle brush movement amplitude and frequency must also be established before the web charging process is initiated. For three mil, 60 inch wide polyester based web 70 moving at the rate of 1,000 ft/min, it has also been empirically determined that brushes 16 and 18 should have a movement amplitude of $\frac{1}{8}$ inch and that the frequency of brush movement should be approximatley 60 cycles per second. The frequency of brush movement is established by the speed of variable speed motor 36 (FIG. 1) and the amplitude of brush movement is established by the position of push rod 48 (FIG. 2) on cam follower 42.

Figure 2:
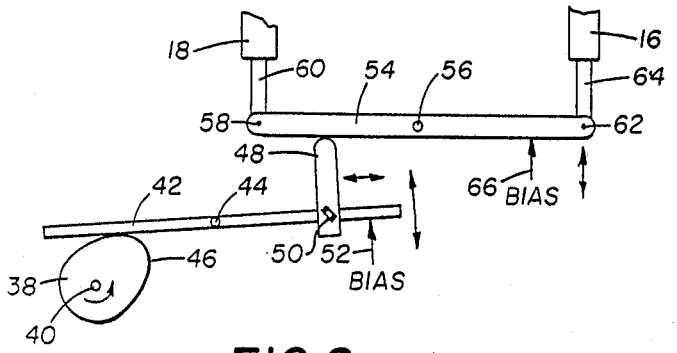
FIG. 2 is a schematic diagram of apparatus coupling the variable speed output of the drive motor in FIG. 1 to the conductive bristle brushes in the electrostatic field generating apparatus shown in said drawing FIG. 1.
Figure 3:
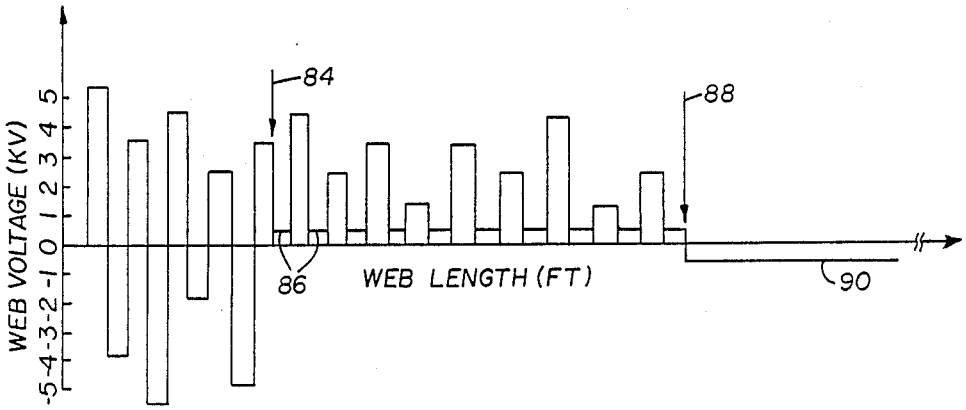
FIG. 3 is a graph of the progressive changes that occur in the electrostatic charge level of a randomly charged web as it is moved through the web charge controlling apparatus of drawing FIG. 1.

With reference to FIGS. 1, 2 and 3, once the output voltages of power supplies 20 and 30 and the movement amplitude and frequency of brushes 16 and 18 have been established, web 70 is moved by conventional drive means (not shown) coupled through mandrel 72 to said web 70, over idler roller 76 and then through the fairly intense positive electrostatic field in the gap between the free ends of the brushes of conductive bristle brush 16 and the cylindrical outer surface of electrically conductive backing roll 12. As shown in the graph of web voltage as a function of web length in drawing FIG. 3, web 70 has random positive and negative charges thereon with some of these charges having a magnitude in the vicinity of 5,000 V prior to entering the electrostatic field of brush 16, at web length 84. Web 70 is subsequently moved through the electrostatic field of brush 16 at web length 84 which thereby converts all of the negative electrostatic charges thereon to a positive charge level of approximately 800 V (86).

The positive electrostatic field at brush 16 established by the plus 1,000 VDC output voltatge from power supply 20 is of sufficient magnitude to convert all of the negative electrostatic charges on web 70 to plus 800 V even through many of these charges are several thousand volts greater (more negative) than plus 800 V. This is so because the electrostatic field present at brush 16 provides substantially more energy than is available in an electrostatic charge, regardless of its charge magnitude.

The common polarity electrostatic charge established on web 70 by the electrostatic field of brush 16 at web length 84 does not change as web 70 is moved between brushes 16 and 18 prior to etering the electrostatic field of brush 18, at web length 88. Web 70 is subsequently moved through the electrostatic field of brush 18 at web length 88 which converts all of the electrostatic charges thereon to the desired uniform charge level of minus 200 V (90). The electrostatic field of brush 18 converts all of the electrostatic charges on web 70 to minus 200 V, including the plus 800 V charges created by the electrostatic field of conductive bristle brush 16. Web 70 with a uniform minus 200 V electrostatic charge thereon is then moved over idler rollers 78 and 80 in directin 82 to either a web coating station (not shown) or to a conventional rewind station (not shown) for subsequent storage.

To place a uniform positive electrostatic charge on web 70, the order of the polarity of the voltages applied to conductive bristle brushes 16 and 18 would be reversed as previously explained. The magnitude of the negative voltage applied to brush 16 to produce a final positive charge level on web 70 would be the same as that applied to said brush 16 to produce the above-described negative electrostatic charge on said web 70. However, the magnitude of the final or positive charge applied to brush 18 would depend upon the magnitude of the electrostatic charge level required. To neutralize random electrostatic charges on web 70, opposite polarity voltages must be alternately applied to conductive bristle brushes 16 and 18 in approximately a two-to-one voltage magnitude ratio.

It should be noted that in some web charging arrangements such as that described in the above-mentioned U.S. Pat. No. 4,402,035 to KISLER, a single conductive bristle brush is employed for electrostatic field generating purposes. In such arrangements, improvement in the uniformity of an electrostatic charge applied to a moving web by an electrostatic field generated by a single conductive bristle brush would also result if this single brush was mechanically vibrated in the same general manner as either brush 16 or brush 18 of the present invention.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Apparatus for establishing a uniform electrostatic charge level on a randomly charged web comprising:

means for generating a first corona-free electrostatic field, of predetermined polarity and intensity, at a particular spatial location;

means for generating a second corona-free electrostatic field, of predetermined intensity and of opposite polarity with respect to said first electrostatic field, at a location spaced from said first electrostatic field;

means for vibrating each of said electrostatic fields, in a predetermined direction, at a selected amplitude and frequency; and means for alternately passing said web through each said electrostatic field at a particular angle with respect to its respective direction of electrostatic field vibration to thereby establish a uniform electrostatic charge level on said randomly charged web.

2. The apparatus of claim 1 wherein the said angle of web movement through each said electrostatic field is 90°.

3. The apparatus of claim 1 wherein the electrostatic charges on said randomly charged web are of the bounded and unbounded type.

4. The apparatus of claim 1 wherein said means for vibrating each electrostatic field includes means for simultaneously vibrating said electrostatic fields in opposite directions with respect to one another.

5. The apparatus of claim 1 wherein each of said first and second electrostatic field generating means includes a conductive bristle brush electrode and a conductive reference surface electrode mounted in an opposed relation with each of said fields being established between the free ends of the bristles of a conductive bristle brush electrode and a conductive reference surface electrode.

6. The apparatus of claim 1 wherein the electrostatic field generated by said first electrostatic field generating means produces a positive charge on said randomly charged web and the electrostatic field generated by said second electrostatic field generating means produces a negative electrostatic charge on said randomly charged web.

7. The apparatus of claim 1 wherein the electrostatic field generated by said first electrostatic field generating means produces a negative charge on said randomly charged web and the electrostatic field generated by said second electrostatic field generating means produces a positive electrostatic charge on said randomly charged web.

8. The apparatus of claim 1 wherein the electrostatic field generated by said first electrostatic field generating means produces either a positive or a negative charge on said randomly charged web and the electrostatic field generated by said second electrostatic field generating means produces a neutral electrostatic charge on said randomly charged web.

9. A method of establishing a uniform electrostatic charge level on a randomly charged web, comprising the steps of:

generating a first corona-free electrostatic field of predetermined polarity and intensity at a particular spatial location;

generating a second corona-free electrostatic field, of predetermined intensity and of opposite polarity with respect to said first electrostatic field, at a location spaced from said first electrostatic field;

vibrating each of said electrostatic fields, in a predetermined direction, at a selected amplitude and frequency; and alternately passing said web through each said electrostatic field at a particular angle with respect to its respective direction of electrostatic field vibration to thereby establish a uniform electrostatic charge level on said randomly charged web.

10. The method of claim 9 wherein said electrostatic fields are simultaneously vibrated in opposite directions with respect to one another.

11. Apparatus for establishing a uniform electrostatic charge level on a randomly charged web, comprising:

means for generating a corona-free electrostatic field of predetermined polarity and intensity;

means for vibrating said electrostatic field in a predetermined direction, at a selected amplitude and frequency; and means for passing said web through said electrostatic field at a particular angle with respect to the direction of electrostatic field vibration to thereby establish a uniform electrostatic charge level on said randomly charged web.

* * * * *